US006311770B1

(12) United States Patent
Mullis

(10) Patent No.: US 6,311,770 B1
(45) Date of Patent: Nov. 6, 2001

(54) PITLESS ADAPTER ASSEMBLY

(75) Inventor: Jerry D. Mullis, Monroe, NC (US)

(73) Assignee: Conbraco Industries, Inc., Matthews, NC (US)

( * ) Notice: Subject to any disclaimer, the term of this patent is extended or adjusted under 35 U.S.C. 154(b) by 0 days.

(21) Appl. No.: 09/505,032

(22) Filed: Feb. 16, 2000

(51) Int. Cl.[7] ..... E21B 33/00
(52) U.S. Cl. ..... 166/85.2; 166/88.1
(58) Field of Search ..... 166/85.2, 88.1, 166/115

(56) References Cited

U.S. PATENT DOCUMENTS

| | | | | |
|---|---|---|---|---|
| 2,689,611 | * | 9/1954 | Martinson | 166/85.2 |
| 3,154,148 | | 10/1964 | Peterson . | |
| 3,556,213 | | 1/1971 | Kramer . | |
| 3,645,332 | | 2/1972 | Baker . | |
| 3,711,130 | * | 1/1973 | Betzler | 285/239 |
| 3,722,586 | | 3/1973 | Baker . | |
| 3,759,445 | * | 9/1973 | King | 285/239 |
| 3,791,406 | * | 2/1974 | Phillipps | 285/239 |
| 3,812,910 | * | 5/1974 | Wellstein | 166/85.2 |
| 3,865,513 | | 2/1975 | Clark . | |
| 3,875,698 | | 4/1975 | Clark . | |
| 3,966,238 | * | 6/1976 | Washkewicz et al. | 285/239 |
| 4,037,654 | * | 7/1977 | Lien | 166/85.2 |
| 4,298,065 | | 11/1981 | Baski . | |
| 4,416,328 | | 11/1983 | Baski . | |
| 4,531,664 | | 7/1985 | Baski . | |
| 4,705,112 | * | 11/1987 | Meadows | 166/85.2 |
| 4,850,428 | * | 7/1989 | Paulus | 166/85.2 |
| 5,377,752 | | 1/1995 | Farrara . | |
| 5,746,273 | * | 5/1998 | Surinak | 166/85.2 |
| 5,997,046 | * | 12/1999 | Hoeptner, III | 166/85.2 |

* cited by examiner

*Primary Examiner*—William Neuder
(74) *Attorney, Agent, or Firm*—Adams, Schwartz & Evans, P.A.

(57) ABSTRACT

A pitless adapter assembly for a water well system or the like operable by a pump suspended in the well below the pitless adapter assembly to pump underground water upwardly through a plastic supply pipe to a feed pipe through a fitting in a well casing, and including a housing having a generally right-angle flow path therein defined by an housing inlet and a housing outlet for interconnecting the supply pipe with the feed pipe through the well casing. The housing includes an integrally-formed eyelet for receiving and retaining a safety cable to which the pump is suspended in the well and a plurality of annular serrations formed in the walls of the housing surrounding the housing inlet for receiving and retaining an upper end of the feed pipe. Interior walls of the housing defining the flow path extend between the housing inlet and the housing outlet and are curved to provide right-angle turn which reduces turbulence in the water flowing through the housing from the supply pipe to the feed pipe.

11 Claims, 4 Drawing Sheets

PITLESS ADAPTER ASSEMBLY

TECHNICAL FIELD AND BACKGROUND OF THE INVENTION

This invention relates to a pitless adapter assembly. A pitless adapter is a unit designed to permit water service pipes to pass through the wall of a well-casing below the frost line to prevent entrance of contaminants, to prevent freezing of water in the pipes, and to provide full access to the water system components within the well. Pitless adapters hang the well pump from a hole drilled in the well-casing. The hole drilled in the well casing both holds up the weight of the pump and the supply pipe and water from the pump, and allows the pumped water to exit through the casing wall. Existing products require multiple attachments to be furnished as separate items when using plastic pipe for installing a pitless adapter. The majority of submersible well pumps are now installed with plastic pipe. This requires separate fittings not furnished as a package with existing products. Plastic pipe facilitates pump installation and removal because of its flexibility and does not require extending the pipe vertically thereby creating a dangerous situation, especially when the well may be hundreds of feet deep.

Even though plastic pipe is now the preferred installation method, a potential exists for the pipe coming off of the adapter. Should this occur, the well can be rendered unusable and non-repairable. The assembly disclosed and claimed herein provides a compact, ready-to-install unit which includes integral plastic pipe barbs and protected safety cable attachment device. In addition, the invention also includes a streamlined, curved internal shape which reduces water turbulence and increases flow.

SUMMARY OF THE INVENTION

Therefore, it is an object of the invention to provide a pitless adapter which is simple to install.

It is another object of the invention to provide a pitless adapter which securely retains the pump suspended therefrom.

It is another object of the invention to provide a pitless adapter which reduces turbulence and friction-induced drag within the assembly.

It is another object of the invention to provide a pitless adapter which permits connection to plastic supply pipe delivering water from the well to the pitless adapter without the need of other attachment components.

It is another object of the invention to provide an integrally-formed safety eyelet for retaining a safety cable attached to the pump in the well.

It is another object of the invention to provide an integrally-formed safety eyelet for retaining a safety cable attached to the pump in the well which is recessed into the overall dimensions of the pitless adapter and this thus protected from accidental impact.

These and other objects of the present invention are achieved in the preferred embodiments disclosed below by providing a pitless adapter assembly for a water well system or the like operable by a pump suspended in the well below the pitless adapter assembly to pump underground water upwardly through a plastic supply pipe to a feed pipe through a fitting in a well casing, and comprising a housing having a generally right-angle flow path therein defined by an housing inlet and a housing outlet for interconnecting the supply pipe with the feed pipe through the well casing. The housing includes an integrally-formed eyelet for receiving and retaining a safety cable to which the pump is suspended in the well and a plurality of annular serrations formed in the walls of the housing surrounding the housing inlet for receiving and retaining an upper end of the feed pipe. Interior walls of the housing defining the flow path extend between the housing inlet and the housing outlet and are curved to provide right-angle turn which reduces turbulence in the water flowing through the housing from the supply pipe to the feed pipe.

According to one preferred embodiment of the invention, the housing includes a threaded collar for receiving a matingly threaded pull pipe.

According to another preferred embodiment of the invention, the threaded collar is integrally-formed with the housing.

According to yet another preferred embodiment of the invention, the housing includes a pair of integrally-formed flanges for cooperating with a mating pair of recesses in a fitting positioned through a hole in the well casing for retaining the pitless adapter assembly in the fitting.

According to yet another preferred embodiment of the invention, the flanges and recesses are adapted to be oriented in vertically-extending relation within the well casing.

Preferably, the safety eyelet is integrally formed in the housing at a juncture between the threaded collar and the housing intermediate the housing inlet and the housing outlet.

Preferably, the flanges are integrally-formed on the housing.

According to yet another preferred embodiment of the invention, the annular serrations comprise a plurality of concentric, ring-shaped barbs each having a taper which progressively enlarges in the flow direction of water from the well into the housing.

According to yet another preferred embodiment of the invention, the pitless adapter includes a submersible pump suspended in the well below the pitless adapter assembly and interconnected thereto by the supply pipe.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
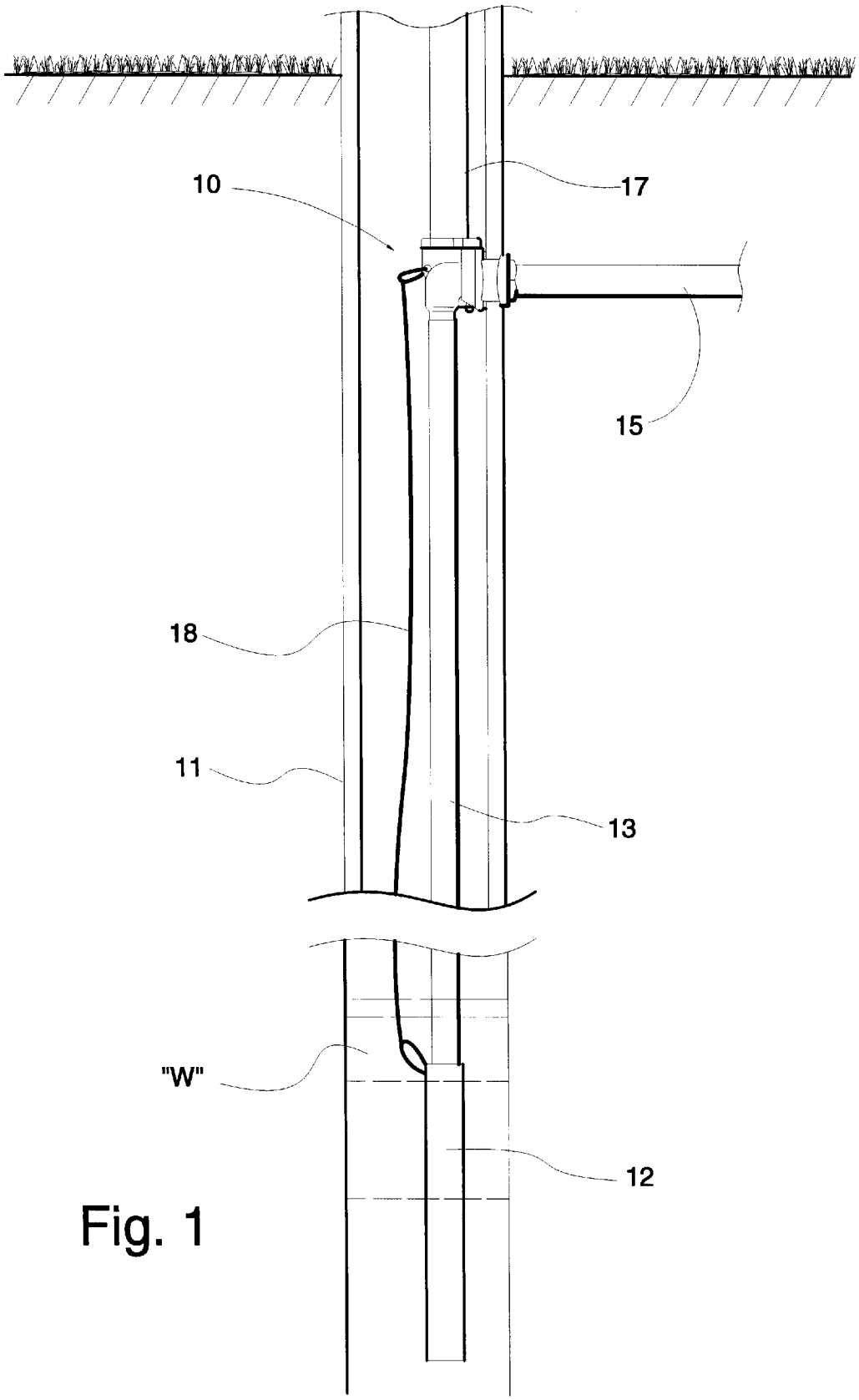
FIG. 1 is a side elevational view of a typical well design where a pitless adapter according to the invention is useful.

Referring now specifically to the drawings, a typical water well system including pitless adapter 10 according to a preferred embodiment of the present invention is illustrated in FIG. 1. In this arrangement, a well "W" is fitted with a well casing 11 in the upper extent thereof in accordance with local regulations. A submersible pump 12 is suspended in the well "W" below the water level on one end of a supply pipe 13. The upper end of the supply pipe 13 is attached to the inlet side of the pitless adapter 10, as described in further detail below. Water from the supply pipe 13 passes through the pitless adapter 10 and into a feed pipe 15, which delivers water to a building, such as a house, or to a storage tank. The pitless adapter 10 is supported in its position by the side walls of the well casing 11 through which it extends. A pull pipe 17 is threaded into a top end of the pitless adapter 10 and permits the pitless adapter 10 and the pump 12 to be pulled from the well "W" when necessary.

A strong wire safety cable 18 interconnects the pitless adapter 10 and the pump 12 and provides secondary security against loss of the pump 12 in the bottom of the well "W" should the supply pipe 13 disconnect for whatever reason from either the pitless adapter 10 or the pump 12. Electrical connections, not shown, supply power to the pump 12.

Figure 2:
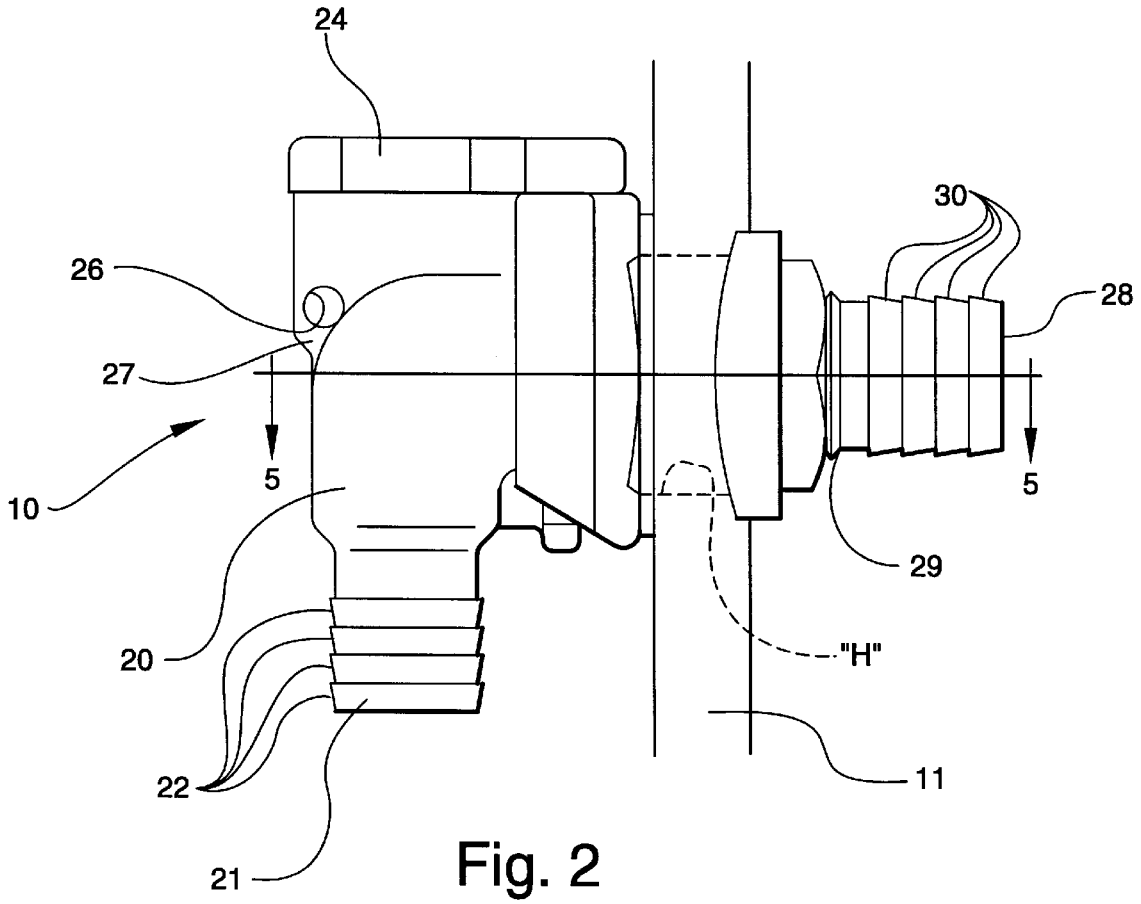
FIG. 2 is a fragmentary side elevation of a pitless adapter according to a preferred embodiment of the invention.

Referring now to FIG. 2, the pitless adapter 10 is preferably formed of cast bronze in accordance with ASTM B584-C84400. A housing 20 includes an inlet portion 21 having a plurality of annular serrations or barbs 22 on the outer surface thereof. This arrangement permits easy and quick attachment to plastic supply pipe without additional fittings being needed. An integrally-formed threaded collar 24 permits attachment of the pull pipe 17. An eyelet 26 is integrally-formed in the pitless adapter 10 at the juncture between the threaded collar 24 and the housing 20 intermediate the housing inlet 21 and a housing outlet 28 formed in a separate fitting 29 which extends through an access hole "H" in the side of the well casing 11. As is best shown in Figures and 3, the eyelet 26 is formed in an integral web 27 which is recessed within the overall dimensions of the housing 20 at the point where the collar 24 is formed. This protects the attachment point of the cable 18 against an inadvertent impact which could sever the cable 18 and remove the protection against loss of the pump 12 should the supply pipe 13 become disconnected.

The fitting 29 also includes a plurality of annular serrations or barbs 30 on the outer surface thereof which permits easy and quick attachment to plastic feed pipe without additional fittings being attached.

Figure 3:
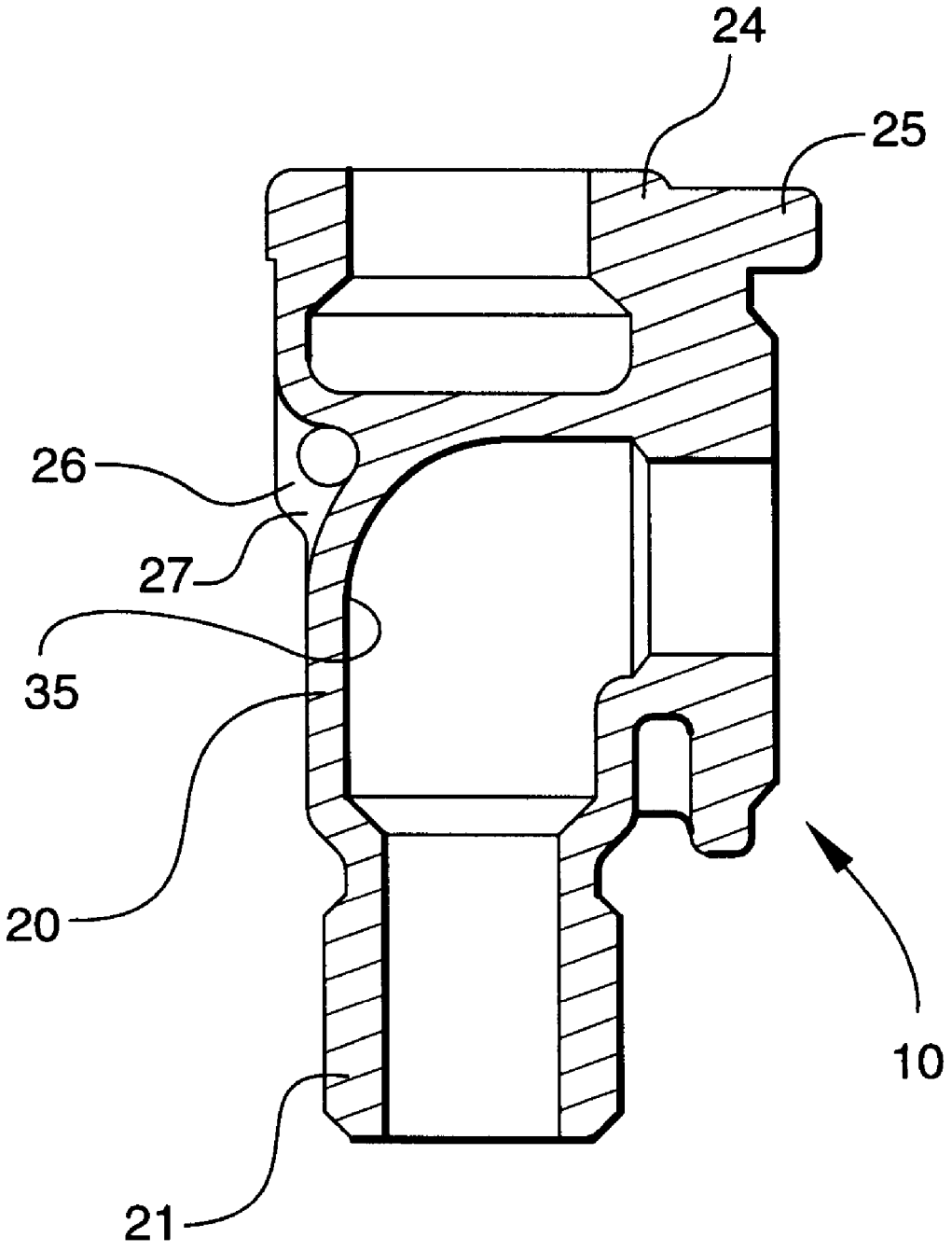
FIG. 3 is a partial vertical cross-section of the pitless adapter shown in FIG. 2, showing the portion of the pitless adapter in the interior of the well casing.

Referring now to FIG. 3, the portion of the pitless adapter 10 which is positioned within the well casing 11 is shown in cross-section. As is shown, the inlet 21 and outlet 28 communicate with a passage 35 which extends at right angles through the housing 20. The passage 35 defines a smoothly curved right-angle transition intermediate the inlet 21 and outlet 28, providing a correspondingly smooth, non-turbulent flow of water from the well upwardly into the pitless adapter 10 and into the feed pipe 15.

Figure 5:
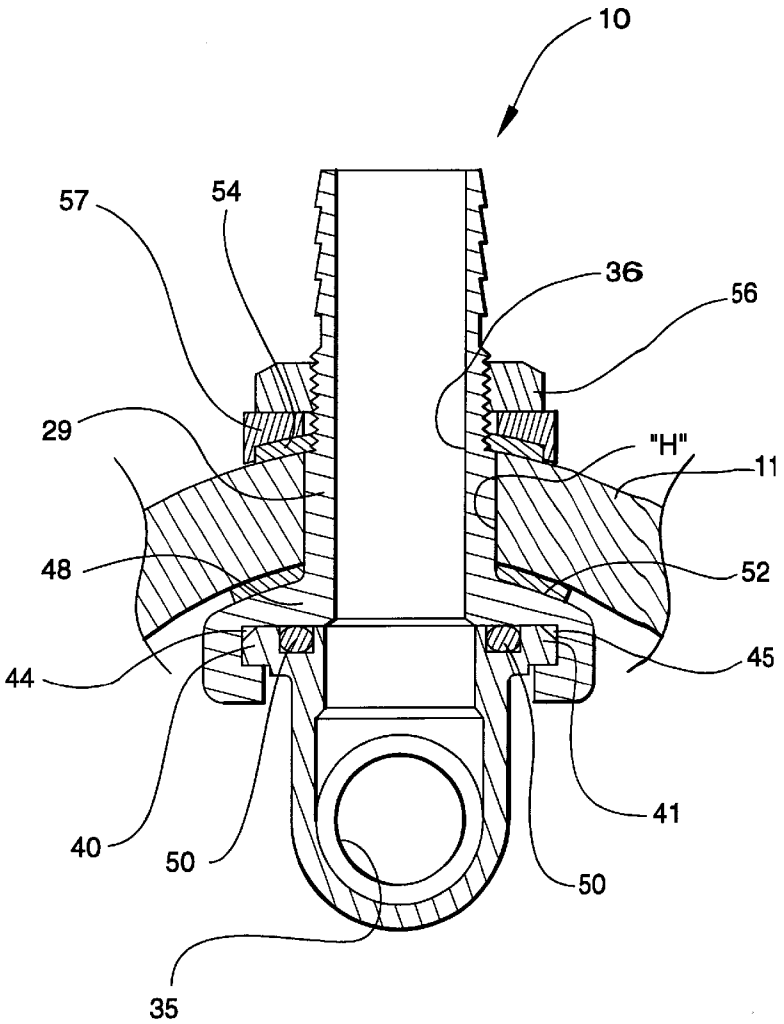
FIG. 5 is a horizontal cross-section taken substantially along lines 5—5 of FIG. 2.
Figure 4:
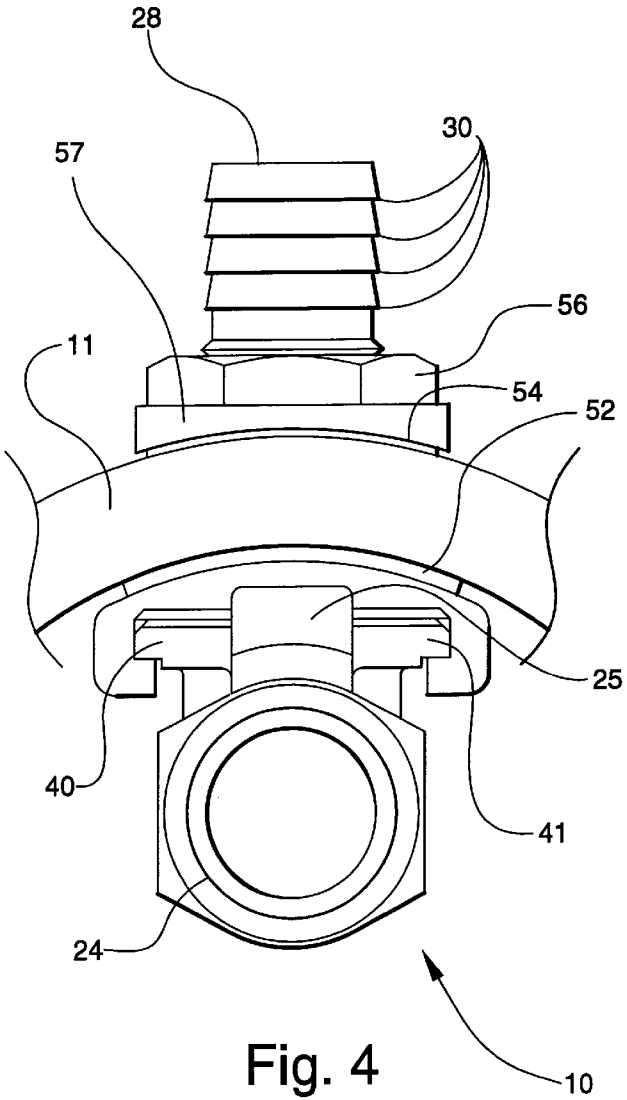
FIG. 4 is a top plan view of the pitless adapter shown in FIG. 2.

As is best shown in FIGS. 4 and 5, the fitting 29 includes a passage 36 which interconnects with the passage 35 in housing 20. The interconnection is maintained by means of a pair of flanges 40, 41 which are received within a pair of recesses 44, 45 formed in an enlarged retaining bracket 48 in fitting 29. As is shown in both FIG. 4 and FIG. 5, an elastomeric O-ring 50 provides a water-tight seal between the flanges 40, 41 and the recesses 44, 45. An elastomeric gasket 52 provides a water-tight seal between the retaining bracket 48 and the inner wall of the well casing 11. An elastomeric gasket 54 provides a water-tight seal between the retaining bracket fitting 29 and the outer wall of the well casing 11. A compression nut 56 is threaded onto the fitting 29 and tightened against a collar 57 to compress the gaskets 52 and 54. The O-ring 50 is lubricated and the housing 20 is slid into the fitting 29.

The pitless adapter 10 is assembled by cutting the hole "H" in the sidewall of the well casing 11 so that the hole "H" will be at the appropriate distance below ground level when inserted into the well. Installation may proceed in one of several different ordered steps. According to one installation method, after the well casing 11 has been inserted into the well, the fitting 29 with the gasket 52 in place is passed through the hole "H" from the inside so that the outlet 28 extends laterally outwardly through the well casing 11. The pump 12 is connected by properly measured supply pipe 13 to the inlet 21 and the safety cable 18 is attached to the eyelet 26 of the housing 20. The pull pipe 17 is attached to the pitless adapter 10 and the assembly is lowered into the well. The housing 20 is connected to the fitting 29 by inserting the flanges 40, 41 into the recesses 44, 45 of the bracket 48 until the passages 35 and 36 are aligned. A stop tab 25 formed in the housing 20 prevents movement of the housing 20 past the proper alignment point on the fitting 29. The collar 57 is placed onto the fitting 29 and the compression nut 56 is tightened to the proper torque, completing the assembly.

While the pitless adapter 10 is shown in use with a submersible pump, it may also be used with a jet pump. In such cases, either two well pipes or two pitless adapters would be required. The integrally-formed barbs 22 and 30 permit easy attachment of plastic supply and feed pipes 13 and 15, respectively without other attachment pieces.

A pitless adapter is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A pitless adaptor for a water well system operatable by a pump suspended in the well below the adapter assembly to pump underground water upwardly through a plastic supply pipe to a feed pipe through a well casing, and comprising a housing having a generally right-angle flow path therein defined by a housing inlet and a housing outlet for interconnecting the supply pipe with the feed pipe through the well casing, said housing including:

(a) an integrally-formed eyelet for receiving and retaining a safety wire to which the pump is attached, said eyelet being positioned on a longitudinally-extending exterior wall of the housing in a recess in said exterior wall of sufficient depth that the eyelet does not project outwardly beyond the plane of the exterior wall in order to prevent damage to the eyelet from impact with the well casing during installation and maintenance of the housing;

(b) a plurality of annular serrations formed in the walls of the housing surrounding the housing inlet for receiving and retaining an upper end of the feed pipe; and (c) walls of the housing defining the flow path between the housing inlet and the housing outlet defining a radius intermediate the housing inlet and the housing outlet and thereby defining a curved flow path which is at least the diameter of the housing inlet and the lousing outlet along its entire length to reduce turbulence in the water flowing through the housing from the supply pipe to the feed pipe.

2. A pitless adapter assembly according to claim 1, wherein said housing includes a threaded collar for receiving a matingly threaded pull pipe.

3. A pitless adapter assembly according to claim 2, wherein said threaded collar is integrally-formed with said housing.

4. A pitless adapter assembly according to claim 1, wherein said housing includes a pair of integrally-formed flanges and a separate fitting having a mating pair of recesses, said fitting adapted for being positioned through a hole in the well casing for retaining the housing of the pitless adapter assembly in the fitting.

5. A pitless adapter assembly according to claim 4, wherein said flanges and recesses are adapted to be oriented in vertically-extending relation within the well casing.

6. A pitless adapter assembly according to claim 3, wherein said safety eyelet is integrally formed in said housing at a juncture between the threaded collar and the housing intermediate the housing inlet and the housing outlet.

7. A pitless adapter assembly according to claim 5, wherein said flanges are integrally-formed on said housing.

8. A pitless adapter assembly according to claim 1, wherein said annular serrations comprise a plurality of concentric, ring-shaped barbs having a taper which progressively enlarges in the flow direction of water from the well into the housing.

9. A pitless adapter assembly according to claim 1, and including a fitting for being positioned in a hole through the well casing and sealingly interconnected with the outlet of the housing for permitting flow of water from the interior to the exterior of the well casing.

10. A pitless adapter assembly according to claim 1, and including a submersible pump suspended in said well below said pitless adapter assembly and interconnected thereto by the supply pipe.

11. A pitless adaptor assembly according to claim 2, wherein the recess within which the eyelet is positioned is formed between said threaded collar and radiused exterior walls of the housing defining the curved flow path.

* * * * *